US009416617B2

(12) United States Patent
Wiese et al.

(10) Patent No.: US 9,416,617 B2
(45) Date of Patent: Aug. 16, 2016

(54) DOWNHOLE TOOL HAVING SLIP INSERTS COMPOSED OF DIFFERENT MATERIALS

(71) Applicant: Weatherford/Lamb, Inc., Houston, TX (US)

(72) Inventors: Stephen Wiese, Houston, TX (US); Jonathan Young, Houston, TX (US); James Alan Rochen, Waller, TX (US); Matthew Stage, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 225 days.

(21) Appl. No.: 14/172,542

(22) Filed: Feb. 4, 2014

(65) Prior Publication Data

US 2014/0224477 A1 Aug. 14, 2014

Related U.S. Application Data

(60) Provisional application No. 61/763,718, filed on Feb. 12, 2013.

(51) Int. Cl.
*E21B 33/12* (2006.01)
*E21B 33/129* (2006.01)
*E21B 19/10* (2006.01)

(52) U.S. Cl.
CPC ..... *E21B 33/129* (2013.01); *E21B 19/10* (2013.01); *E21B 33/1291* (2013.01)

(58) Field of Classification Search
CPC ..... E21B 23/00; E21B 33/12
See application file for complete search history.

(56) References Cited

U.S. PATENT DOCUMENTS 5,131,468 A 7/1992 Lane et al.
5,271,468 A 12/1993 Streich et al.
5,701,950 A * 12/1997 Imamura ..... F24F 3/044 165/222
5,701,959 A 12/1997 Hushbeck et al.
5,839,515 A * 11/1998 Yuan ..... E21B 33/1293 166/118
5,984,007 A 11/1999 Yuan et al.
6,564,871 B1 5/2003 Roberts (Continued)

FOREIGN PATENT DOCUMENTS

CN 102918227 A 2/2013

OTHER PUBLICATIONS

Weatherford, "WRP Bridge Plug," obtained from www.weatherford.com copyright 2007, brochure No. 2640.00, 3 pages.

(Continued)

*Primary Examiner* — William P Neuder
(74) *Attorney, Agent, or Firm* — Blank Rome, LLP

(57) ABSTRACT

A downhole tool, such as a fracture plug used during a fracture operation, installs in a downhole tubular, such as casing. The tool has a mandrel with a sealing element disposed thereon between uphole and downhole ends. Slip assemblies on the mandrel can be moved to engage the downhole tubular. The uphole assembly has inserts composed of ceramic material, and the downhole assembly has inserts composed of a metallic material. When the tool is used as a bridge plug, the uphole assembly supports the sealing element compressed, and the downhole assembly supports fluid pressure downhole of the tool. In one particular embodiment, the metallic material is a powdered metal material, such as a sintered-hardened powdered metal steel having a balance of iron, an admixture of carbon, and alloy components of molybdenum, chromium, and manganese.

27 Claims, 9 Drawing Sheets

(56) References Cited

U.S. PATENT DOCUMENTS

| | | | | |
|---|---|---|---|---|
| 6,976,534 | B2 * | 12/2005 | Sutton | E21B 33/129 166/118 |
| 7,124,831 | B2 | 10/2006 | Turley et al. | |
| 7,779,906 | B2 | 8/2010 | Porter et al. | |
| 7,779,927 | B2 | 8/2010 | Turley et al. | |
| 8,047,279 | B2 | 11/2011 | Barlow et al. | |
| 8,113,276 | B2 | 2/2012 | Greenlee et al. | |
| 2005/0069691 | A1 * | 3/2005 | Sutton | E21B 33/129 428/297.4 |
| 2008/0199642 | A1 * | 8/2008 | Barlow | B29C 43/021 428/34.5 |
| 2009/0038790 | A1 | 2/2009 | Barlow | |
| 2010/0206550 | A1 | 8/2010 | Barlow et al. | |
| 2011/0240295 | A1 | 10/2011 | Porter et al. | |
| 2012/0097384 | A1 | 4/2012 | Valencia | |
| 2013/0048271 | A1 * | 2/2013 | VanLue | E21B 33/128 166/118 |
| 2014/0090831 | A1 * | 4/2014 | Young | E21B 33/129 166/188 |

OTHER PUBLICATIONS

Weatherford, "Packer Service Tools," obtained from www.weatherford.com copyright 2010, brochure No. 1205.01, 90 pages.
Weatherford, "FracGuard Composite Plugs," obtained from www.weatherford.com, copyright 2004, brochure No. 744.00, 8 pages.
First Office Action in counterpart Canadian App. 2,842,373, dated Jul. 27, 2015.
First Office Action in counterpart Chinese App. 201410048841.X, dated Dec. 4, 2015.
Partial Search Report in counterpart European App. 14154818.0, dated May 9, 2016.

* cited by examiner

DOWNHOLE TOOL HAVING SLIP INSERTS COMPOSED OF DIFFERENT MATERIALS

CROSS-REFERENCE TO RELATED APPLICATIONS

This application claims the benefit of U.S. Provisional Appl. No. 61/763,718, filed 12 Feb. 2013, which is incorporated herein by reference.

BACKGROUND OF THE DISCLOSURE

Slips are used for various downhole tools, such as bridge plugs and packers. The slips can have inserts or buttons to grip the inner wall of a casing or tubular. Inserts for slips are typically made from cast or forged metal, which is then machined and heat-treated to the proper engineering specifications according to conventional practices.

Inserts for slips on metallic and non-metallic tools (e.g., packers, plugs, etc.) must be able to engage with the casing to stop the tools from moving during its operation. On non-metallic tools, such as composite plugs, the inserts can cause the non-metallic slips to fail when increased loads are applied. Of course, when the slip fails, it disengages from the casing. On non-metallic tools, the inserts also need to be easily milled up to assist in the removal of the tools from the wellbore.

When conventional inserts are used in non-metallic slips, they are arranged and oriented as shown in FIG. 1A, for example. The slip 20 is disposed adjacent a mandrel 10 of a downhole tool, such as a bridge plug, a packer, or the like. As shown in FIG. 1B, the slip 20 moves away from the mandrel 10 and engages against a surrounding tubular or casing wall when the slip 20 and a cone 12 are moved toward one another. Either the slip 20 is pushed against the ramped surface of the cone 12, the cone 12 is pushed under the slip 20, or both.

FIG. 2A illustrates a side cross-section of a slip 20 having holes 23 according to the prior art for inserts (not shown), and FIG. 2B illustrates a side cross-section of the slip 20 with inserts 30 disposed in the holes 23. FIG. 2C illustrates a front view of the slip 20 with the holes 23 for the inserts (not shown). The slip 20 can have a semi-cylindrical shape. The holes 23 in the surface of the slip 20 can be an array of blind pockets. The inserts 30 are anchor studs that load into the holes 23 and can be held with a press fit or adhesive.

Examples of downhole tools with slips and inserts such as those above are disclosed in U.S. Pat. Nos. 5,984,007; 6,976,534; and 8,047,279. Other examples include Halliburton Obsidian® and Fas Drill® Fusion composite plugs and Boss Hog frac plugs. (OBSIDIAN and FAS DRILL are registered trademarks of Halliburton Energy Services, Inc.)

One particular type of downhole tool having slips is a composite fracture plug used in perforation and fracture operations. During the operations, the composite plugs need to be drilled up in as short of a period of time as possible and with no drill up issues. Conventional composite plugs use metallic wicker style slips, which are composed of cast iron. These metallic slips increase the metallic content of the plug and can cause issues during drill up in horizontal wells, especially when coil tubing is used during the milling operation.

Due to the drawbacks of cast iron slips, composite slips having inserts, such as described above, are preferably used to reduce the issues associated with metallic slips. Unfortunately, a large amount of metallic debris can still collect at the heel of the well and cause drill up problems when composite slips having inserts are used on tools. When composite slips are used, for example, the inserts are typically composed of carbide, which is a dense and heavy material. In other developments, it is known to use a composite slip with two different insert materials (i.e., ceramic and metallic) in the same insert, such as described in U.S. Pat. No. 6,976,534.

In any event, when the downhole tool having slips with carbide inserts are milled out of the casing, the inserts tend to collect in the casing and are hard to float back to the surface. In fact, in horizontal wells, the carbide inserts may tend to collect at the heel of the horizontal section and cause potential problems for operations. Given that a well may have upwards of forty or fifty bridge plugs used during operations that are later milled out, a considerable number of carbide inserts may be left in the casing and difficult to remove from downhole.

The subject matter of the present disclosure is directed to overcoming, or at least reducing the effects of, one or more of the problems set forth above.

SUMMARY OF THE DISCLOSURE

A downhole apparatus or tool, such as a composite bridge plug used during a fracture or perforation operations, installs in a downhole tubular, such as casing. The tool can have a mandrel with a sealing element disposed thereon. The sealing element can be compressible to engage the downhole tubular when the tool is activated by a wireline unit or the like.

A first slip is disposed on the tool and is movable relative to the tool to engage the downhole tubular. For example, the first slip can be disposed toward an uphole end of the tool's mandrel. Similarly, a second slip is disposed on the tool and is movable relative to the tool to engage the downhole tubular. For example, the second slip can be disposed toward a downhole end of the tool's mandrel.

The slips can each have one or more slip bodies, segments, or elements disposed about the mandrel. For example, the segments can be arranged around the tool and can be individual or integrated segments. Other arrangements for the slips can be used. The first and second slips can both be composed of a non-metallic material, such as a plastic, a molded phenolic, a composite, a laminated non-metallic composite, an epoxy resin polymer with a glass fiber reinforcement, an ultra-high-molecular-weight polyethylene (UHMW), a polytetrafluroethylene (PTFE), etc.

In one embodiment, the first (uphole) slip has only one or more first inserts composed of ceramic material in exclusion of inserts composed of other materials being used on the first slip, and the second (downhole) slip has only one or more second inserts composed of a metallic material in exclusion of inserts composed of other materials being used on the second slip. When the tool is used as a fracture plug, for example, the uphole slip with only ceramic inserts engages the downhole tubular and primarily supports the sealing element compressed. In this case, use of only the first inserts composed of the ceramic material can reduce the overall metallic content of the plug, but can still support the sealing element compressed.

On the other hand, the downhole slip with only the metallic inserts engages the downhole tubular with the metallic inserts and primarily supports fluid pressure downhole of the tool. In this case, use of only the second inserts composed of the metallic material can still reduce the overall metallic content of the plug. Yet, the metallic inserts on the downhole slip can better support the increased fluid pressure downhole of the tool during operations.

Other arrangements of inserts, slips, materials, and the like are disclosed herein. The ceramic material for the inserts of the slips can be alumina, zirconia, and cermet. As noted above, use of the ceramic material inserts on the uphole slip can reduce the overall metallic content of the tool and can facilitate milling of the tool from the downhole tubular after use.

The metallic material for the second inserts on the slips can use a cast iron, a carbide, a cermet (i.e., composites composed of ceramic and metallic materials), a powdered metal, or a combination thereof. In one particular embodiment, the metallic material is a sintered-hardened powdered metal steel. In one particular arrangement, the sintered-hardened powdered metal steel can consist essentially of a balance of iron, an admixture of carbon, and alloy components of molybdenum, chromium, and manganese.

In another embodiment, a downhole apparatus or tool for engaging in a downhole tubular has a first slip disposed on the tool and is movable relative to the tool to engage the downhole tubular. The first slip is composed of a first material. At least one first insert is exposed on the first slip and is composed of a powdered metal material.

In one particular arrangement, the first slip is disposed toward an uphole end of a mandrel of the tool, and the first slip comprises only one or more of the at least one first inserts composed of the powdered metal in exclusion of inserts of composed of other materials. The tool also has a second slip disposed toward a downhole end of the mandrel. The second slip has only one or more second inserts composed of a metallic material in exclusion of inserts composed of other materials, the metallic material being other than powdered metal material.

In another embodiment, a downhole apparatus or tool for engaging in a downhole tubular has a slip disposed on the apparatus. The slip is movable relative to the apparatus to engage the downhole tubular. At least one insert is exposed on the slip and defines at least a partial hole axially therethrough.

In yet another embodiment, a downhole apparatus or tool for engaging in a downhole tubular has a slip disposed on the downhole tool. The slip is movable relative to the apparatus to engage the downhole tubular, and the slip having an outside surface and first and second ends. The outside surface defines a first hole toward the first end and defines a second hole toward the second end. The first hole has a different depth in the outside surface than the second hole.

A first insert is disposed in the first hole, and a second insert is disposed in the second hole. The first insert has a first length and extending a first extent from the outside surface on the slip. The second insert has a second length and extending a second extent from the outside surface on the slip.

The various arrangements noted herein can be interchanged and combined with one another in accordance with the teachings of the present disclosure. Additionally, the slip can be an individual body or segment, a unitary ring, one of a plurality of independent segments of a slip assembly, or one of a plurality of integrated segments of a slip assembly. The material of the slip can be metallic or non-metallic. In one implementation, the slip's material comprises a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

Although suitable for a downhole tool, such as a fracture plug discussed above, the teaching of the present disclosure can apply to any of a number of downhole tools for engaging in a downhole tubular.

DETAILED DESCRIPTION OF THE DISCLOSURE

Figure 1A:
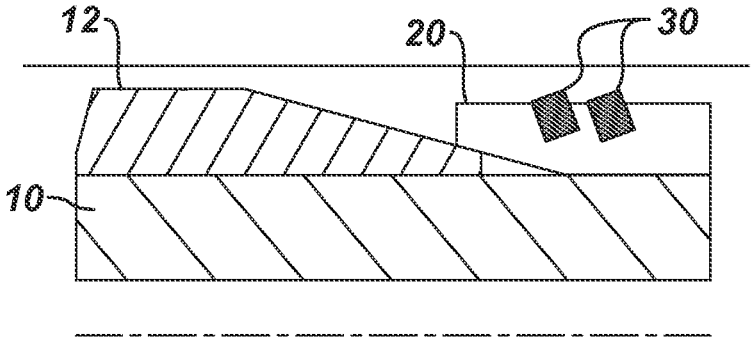
FIG. 1A (Prior Art)
FIG. 1A illustrates inserts used in a non-metallic slip according to the prior art.
Figure 1B:
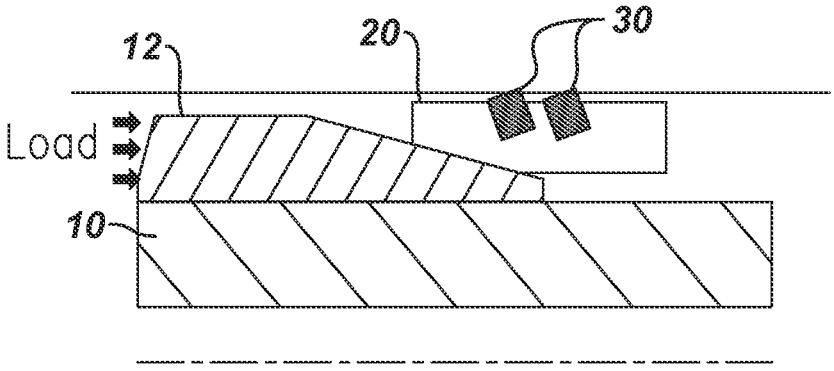
FIG. 1B (Prior Art)
FIG. 1B illustrates the slip of FIG. 1A during use.
Figure 2A:
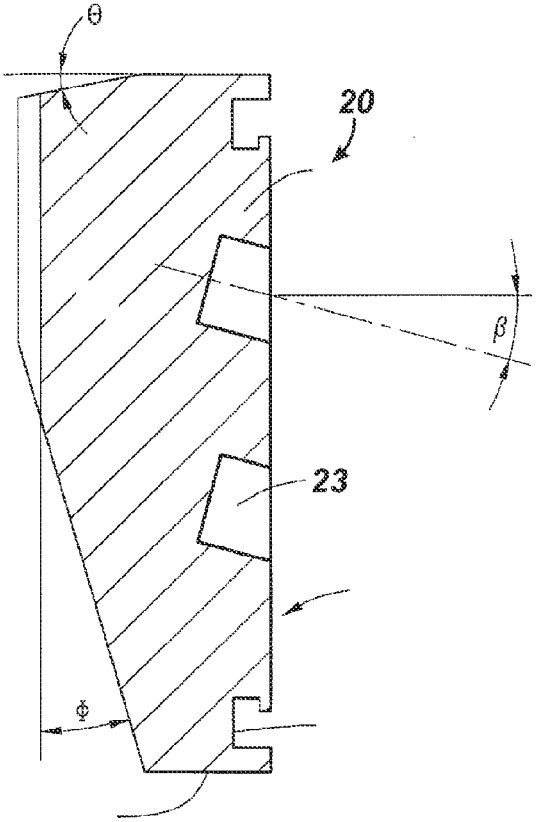
FIG. 2A (Prior Art)
FIG. 2A illustrates a side cross-section of a slip having holes for inserts according to the prior art.
Figure 2B:
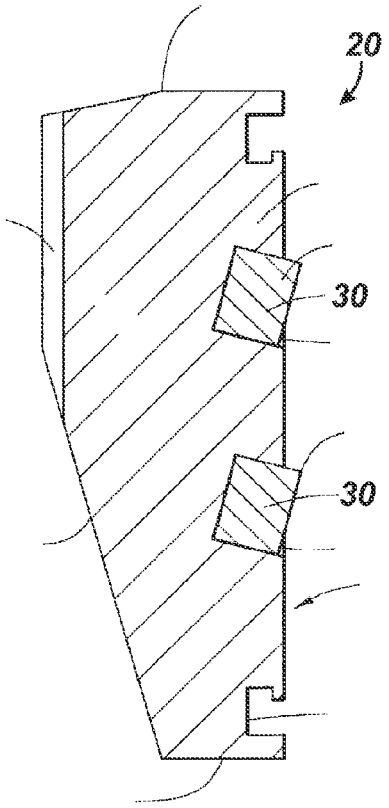
FIG. 2B (Prior Art)
FIG. 2B illustrates a side cross-section of the slip with inserts disposed in the holes.
Figure 2C:
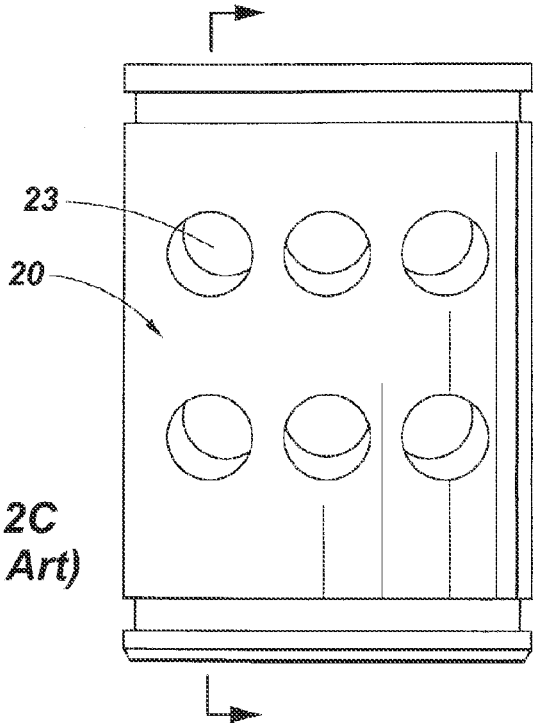
FIG. 2C (Prior Art)
FIG. 2C illustrates a front view of the slip with the holes for the inserts.
Figure 3:
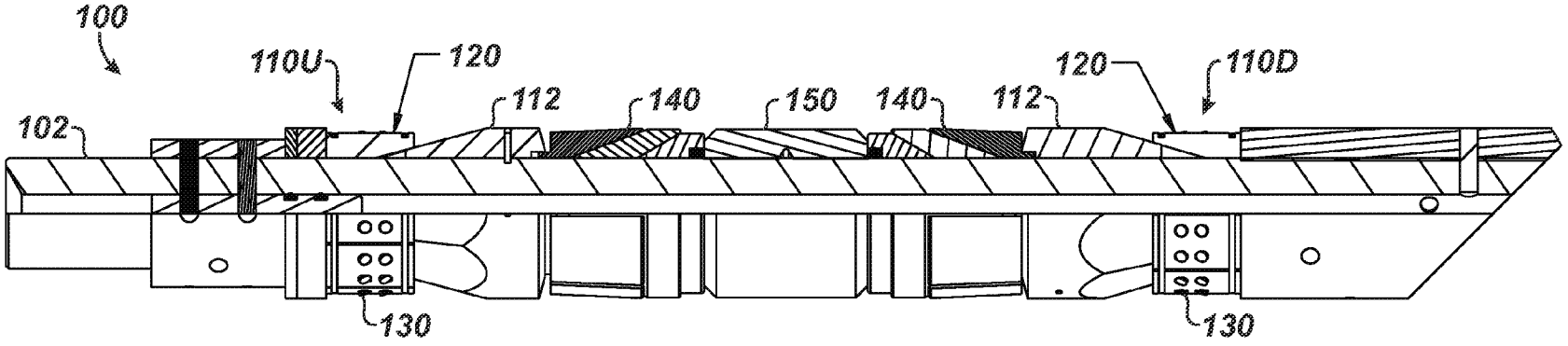
FIG. 3 illustrates a downhole tool in partial cross-section having slip assemblies according to the present disclosure.

FIG. 3 illustrates a downhole tool 100 in partial cross-section having slip assemblies 110U, 110D according to the present disclosure. The downhole tool 100 can be a bridge plug as shown, but it could also be a packer, a liner hanger, an anchoring device, or other downhole tool that uses a slip assembly to engage a downhole tubular, such as casing.

The tool 100 has a mandrel 102 having the slip assemblies 110U and 110D and backup rings 140 arranged on both sides of a packing element 150. Outside the inclined cones 112, the slip assemblies 110U and 110D have slips 120. Together, the slips 120 along with the cones 112 can be referred to as slip assemblies, or in other instances, just the slips 120 may be referred to as slip assemblies. In either case, either reference may be used interchangeably throughout the present disclosure. Thus, reference herein to a slip is not meant to refer only to one slip body, segment, or element, although it can. Instead, reference to slip can refer to more than just these connotations. As shown herein, slip assemblies 110U, 110D can have the same types of slips 120, but other arrangements could be used.

As a bridge plug, the tool 100 is preferably composed mostly of non-metallic components according to procedures and details as disclosed, for example, in U.S. Pat. No. 7,124,831, which is incorporated herein by reference in its entirety. This makes the tool 100 easy to mill out after use.

When deployed downhole, the tool 100 is activated by a wireline setting tool (not shown), which uses conventional techniques of pulling against the mandrel 102 while simultaneously pushing upper components against the slip assemblies 110U, 110D. As a result, the slips 120 of the slip assemblies 110U, 110D ride up the cones 112, the cones 112 move along the mandrel 102 toward one another, and the packing element 150 compresses and extends outward to engage a surrounding casing wall. The backup elements 140 control the extrusion of the packing element 150. In the process, the slips 120 on the assemblies 110U, 110D are pushed outward to engage the wall of the casing (not shown), which both maintains the tool 100 in place in the casing and keeps the packing element 150 contained.

The force used to set the tool 100 may be as high as 30,000 lbf and could be as high as 85,000 lbf. These values are only meant to be examples and could vary for the size of the tool 100. In any event, the set tool 100 isolates upper and lower portions of the casing so that fracture and other operations can be completed uphole of the tool 100, while pressure is kept from downhole locations. When used during fracture operations, for example, the tool 100 may isolate pressures of 10,000 psi or so.

As will be appreciated, any slipping or loosening of the tool 100 can compromise operations. Therefore, the slips 120 need to sufficiently grip the inside of the casing.

At the same time, however, the tool 100 and most of its components are preferably composed of millable materials because the tool 100 is milled out of the casing once operations are done, as noted previously. As many as fifty such tools 100 can be used in one well and must be milled out at the end of operations. Therefore, having reliable tools 100 composed of entirely of millable material is of particular interest to operators. To that end, the slip assemblies 110U, 110D of the present disclosure are particularly suited for tools 100, such as bridge plugs, packers, and other downhole tools, and the challenges they offer.

Figure 4B:
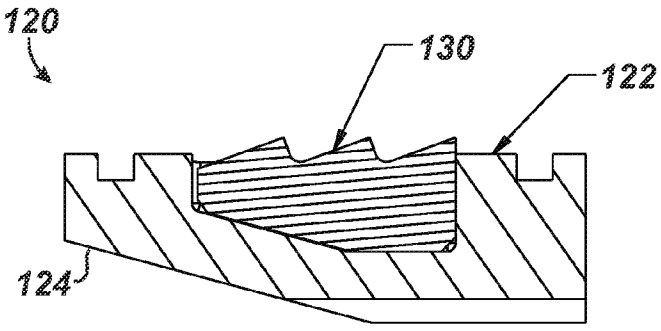
FIG. 4B illustrates a cross-sectional view of a slip having a second type of slip insert.
Figure 4A:
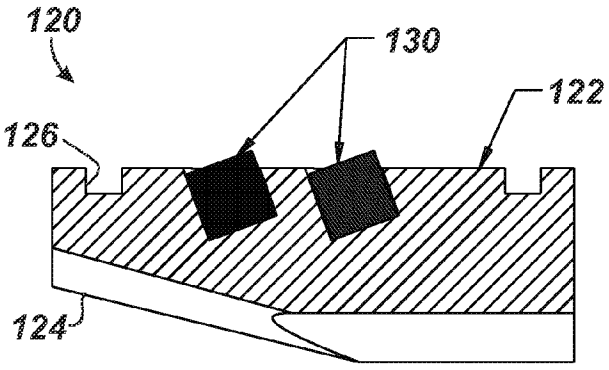
FIG. 4A illustrates a cross-sectional view of a slip having a first type of slip insert.

As shown in FIG. 4A, one type of slip 120 for the assemblies 110 has a slip body or segment 122 with one or more individual inserts or buttons 130 disposed therein. The segment 122 can be one of several used on a slip assembly. The segment 122 can have any number of inserts 130 arranged in one or more rows and/or one or more columns in the top surface. For instance, two rows of inserts 130 may be used, each having the same number of columns. Alternatively, two rows can be used, but one row may have two columns while the other has one column. These and other configurations can be used as will be appreciated.

In one arrangement, the inserts 130 can be the same size and can be disposed in equivalent sized holes in the slip segment 122. In another arrangement, the depth of holes can vary from segment to segment or from slip assembly to slip assembly. Therefore, one or more inserts 130 can be longer than the others. Additionally, the height of the inserts 130 can be the same on the given slip segment 122 once installed, but the depth of the holes can vary. This can reduce the stress around the insert 130 in the base material. Other arrangements may have the inserts 130 at different heights and different depths relative to the slip segment 122. A number of these configurations are described below.

As shown in FIG. 4B, another type of slip 120 for the assemblies 110 can have a wickered insert 130 disposed in the slip body 122. Still other configurations of slip inserts 130 can be used as disclosed elsewhere herein.

In general, the inserts 130 can be constructed from a long, wide bar or rod that is then machined to the proper length and width and given suitable faces. This technique is well suited for carbide or other hard types of materials and may also be used for other disclosed materials. Alternatively, the insert 130 can be cast or otherwise formed directly with the faces and size needed, if the material and tolerances allow for this.

In both cases, the slip body 122 can comprise one of several independent segments of a slip assembly, such as on assemblies 110U, 110D shown in FIG. 3. As shown in FIG. 3, each body or segment 122 can have the same arrangement and number of inserts 130, although different arrangements can be used. Additionally, each segment 122 can be composed of the same or different materials from the other segments 122, and each insert 130 on a given segment 122 may be composed of the same or different materials from the other inserts 130. In other arrangements, the slip body 122 can be a unitary ring or can be a partially integrated ring, as disclosed herein.

In general, the slip body 122 is composed of a first material, and the one or more inserts 130 are composed of one or more second materials exposed in the body's outer surface. The first material of the slip body 122 can generally be metal, composite, or the like. Preferably, the slip body 122 is composed of a millable material, such as a plastic, a non-metallic material, a molded phenolic, a laminated non-metallic composite, an epoxy resin polymer with a glass fiber reinforcement, an ultra-high-molecular-weight polyethylene (UHMW), a polytetrafluroethylene (PTFE), etc.

The second material used for the inserts 130 can in general include metallic or non-metallic materials. For example, the inserts 130 can be composed of carbide, a metallic material, a cast iron, a composite, a ceramic, a cermet (i.e., composites composed of ceramic and metallic materials), a powdered metal, or the like. Additionally, the inserts 130 preferably have a sufficient hardness, which may be a hardness equivalent to at least about 50-60 Rc.

In one particular embodiment, one or more of the inserts 130 on one or more of the segments 122 for one or both of the assemblies 110U, 110D are made from powdered metallurgy. The physical characteristics of such a powdered metal insert 130 can be tailored for the particular implementation. The powdered metal insert 130 can be tailored to be strong and hard enough to engage with the casing to prevent the tool 100 from moving. Additionally, the powdered metal insert 130 can be made frangible enough for easy removal by milling. As noted previously, conventional inserts may be strong enough to engage with the casing, but are difficult to remove and can damage the equipment used to remove the tool 100. The powdered metal insert 130 made with powder metallurgy can allow the tool 100 to perform correctly, but can improve the speed and ease of the removal of the tool 100 from the wellbore.

The powdered metal insert 130 preferably has a hardness greater than or equal to about 48 HRC and may have a hardness in the range of 48 HRC to 60 HRC. Hardness is one of the driving factors for selecting the particular powdered metal to use for the powdered metal insert 130 because casings, such as P-110 grade casing, can be significantly hard. Therefore, the powered metal used is preferably of a high grade.

The powdered metal used can include a sinter-hardened powder metal steel material, although other types of powder metals, such as steel, iron, or high carbon steel materials can be used. Manufacture of the powdered metal insert 130 preferably involves forming the insert 130 as a completed part without the need for significant post machining required because any post machining may require using electric discharge machining (EDM) or grinding operations.

The sintered-hardened powdered metal steel materials have a balance of iron and use nickel, molybdenum, chromium, and manganese as major alloying components with elemental copper and nickel used in some cases. Graphite powder (carbon) is admixed to provide a necessary level of carbon for the material. One particular sintered-hardened powder metal steel for use with the powdered metal insert 130 has the material designation according to the Metal Powder Industries Federation (MPIF) Standard 35 of FL-5305, which is composed as indicated in the chart below.

| Material Designation | Fe | C | Ni | Mo | Cu | Mn | Cr | Element (%) |
|---|---|---|---|---|---|---|---|---|
| FL-5305 | Bal. | 0.4 | — | 0.40 | — | 0.05 | 2.7 | Minimum |
| | Bal. | 0.6 | — | 0.60 | — | 0.30 | 3.3 | Maximum |

Some particular hardness properties of one type of powdered metal material FL-5305-135HT includes macro-indentation hardness (apparent) of 35 HRC and a micro-indentation hardness (converted) (F) of 55 Rc. The sintered-hardened powdered metal steel may be manufactured by pressing, presintering, repressing, and sintering and can be hardened during the cooling cycle following sintering.

The shape of the one or more powdered metal insert 130 can be the same or different from one another and any other inserts 130 composed of other materials. In general, the powdered metal insert 130 can be cylindrical as shown in FIG. 4A or can have other shapes, such as the wickered shape shown in FIG. 4B. Alternatively, the powdered metal insert 130 can have different geometries, such as those disclosed in U.S. application Ser. No. 14/039,032, filed 27 Sep. 2013, which is incorporated herein by reference in its entirety.

Figure 5A:
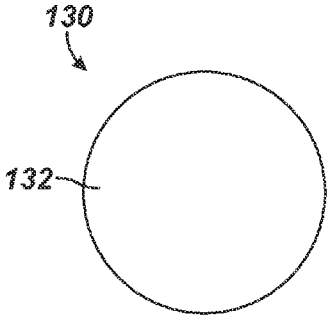
FIGS. 5A-5C illustrate top, cross-sectional, and perspective views of one configuration of slip insert.
Figure 5B:
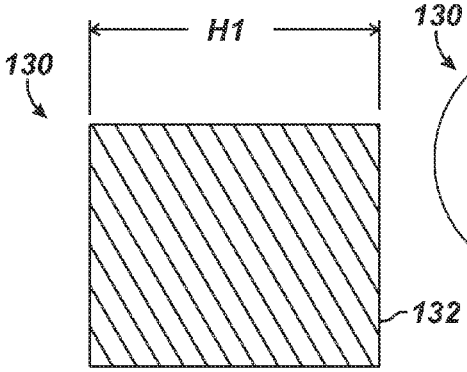
Figure 5C:
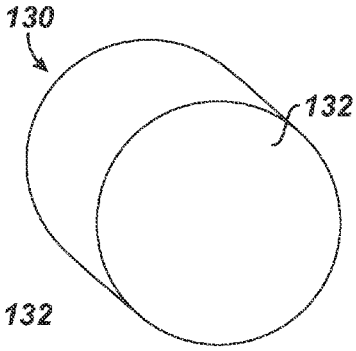

For instance, FIGS. 5A through 6C show examples of suitable geometries for the powdered metal insert 130. FIGS. 5A-5C show top, cross-sectional, and perspective views of a cylindrical shape for a powered metal insert 130 of the present disclosure. The generally cylindrical insert 130 can have a diameter of about 0.3150-in., as shown on the top 132 of FIG. 5A. The overall height H1 can be about 0.375-in. These and other dimensions discussed herein are merely meant to provide example values.

Figure 6A:
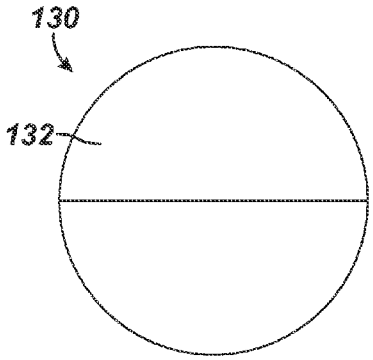
FIGS. 6A-6C illustrate top, cross-sectional, and perspective views of another configuration of slip insert.
Figure 6B:
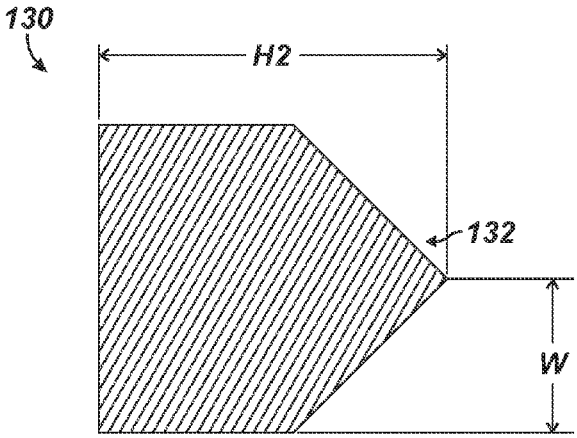
Figure 6C:
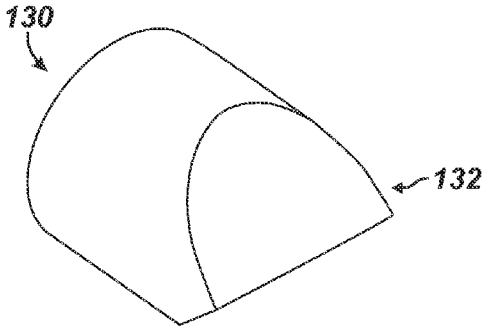

FIGS. 6A-6C show top, cross-sectional, and perspective views of another configuration for a powdered metal insert 130 for the present disclosure. This insert 130 is also generally cylindrical with a diameter of 0.375-in., as shown in FIG. 6A. The insert 130 has an overall height H2 of about 0.423-in. The top end 132 of the insert 130, however, is cusped. Leading and tailing sides of the top end can be angled at 45-degrees. Other possible configurations for the insert 130 are disclosed in incorporated U.S. application Ser. No. 14/039,032.

Figure 7A:
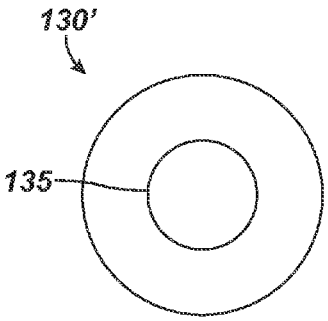
FIGS. 7A-7C illustrate top, cross-section, and perspective views of another configuration of slip insert.
Figure 7B:
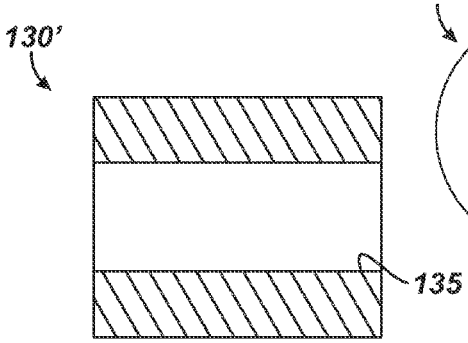
Figure 7C:
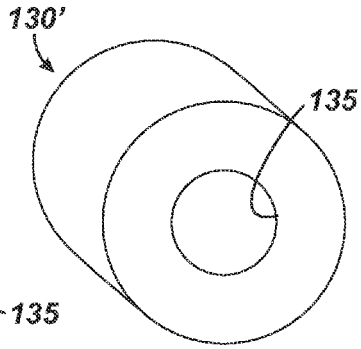
Figure 8A:
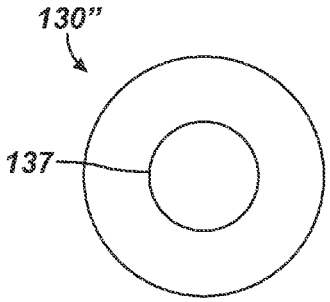
FIGS. 8A-8B illustrate bottom and cross-section views of yet another configuration of slip insert.
Figure 8B:
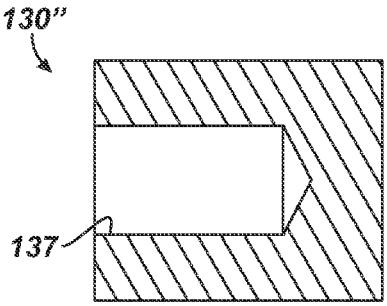

FIGS. 7A-7C illustrate yet another insert 130' for the present disclosure. This insert 130' may also be generally cylindrical, but includes a hole 135 therethrough. In FIGS. 8A-8B, the insert 130" has a partial hole 137 therethrough. For the partial hole 137, the closed end can be used for the gripping surface of the insert 130" or can be disposed in the hole of the segment in which the insert 130" positions. These configurations of inserts 130' and 130" with the hole 135 or partial hole 137 still provide the necessary gripping for the insert 130' and 130" and can be composed of ceramic, metallic, and powder metal materials. For those inserts 130' and 130" composed of metallic material, the hole 135 or partial hole 137 of these configurations reduce the metallic content of the slip using the disclosed inserts 130' and 130".

In general, these inserts 130' and 130" of FIGS. 7A through 8B can be made from metallic materials or non-metallic materials (e.g., ceramic, powdered metal, composite, etc.). The inserts 130' and 130" can be used on an upper slip assembly 110U only, the lower slip assembly 110D only, or both upper and lower slip assemblies 110U, 110D. Moreover, the insert 130' and 130" with the hole 135 or partial hole 137 can be using in combination with solid inserts 130 as disclosed herein and with other inserts 130' and 130" with holes 135 or partial holes 137 in the same given segment of a slip assembly.

Figure 9:
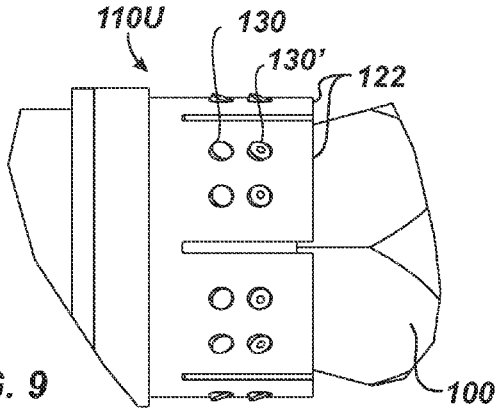
FIG. 9 illustrates a slip assembly having segments and having a configuration of inserts with holes and without holes.

For instance, FIG. 9 shows a slip assembly (i.e., upper assembly 110U) having segments 122 with inserts 130' with full holes (although they could be partial) toward the ramp ends of the segments 122 and with solid inserts 130 away from the ramped ends. Not all segments 122 need to have the same arrangement of inserts 130 and 130'. Thus, as shown in FIG. 9, a given segment 122 has a front row with full hole inserts 130' in two columns and has a back row with solid inserts 130 in two columns. These and other various combinations and arrangements can be used as will be appreciated.

Figure 10A:
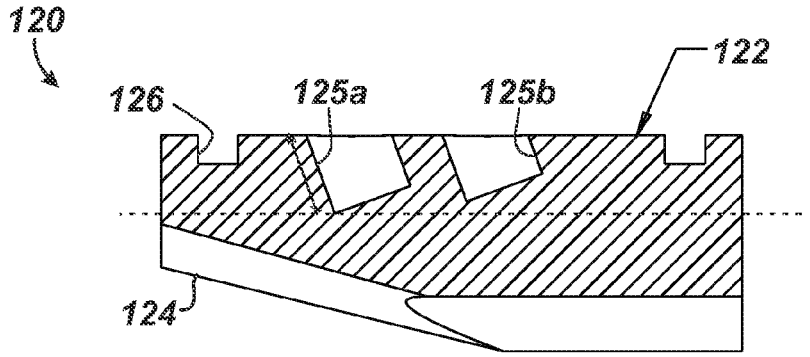
FIG. 10A illustrates a cross-section of a slip segment having different depth holes for holding inserts.
Figure 10B:
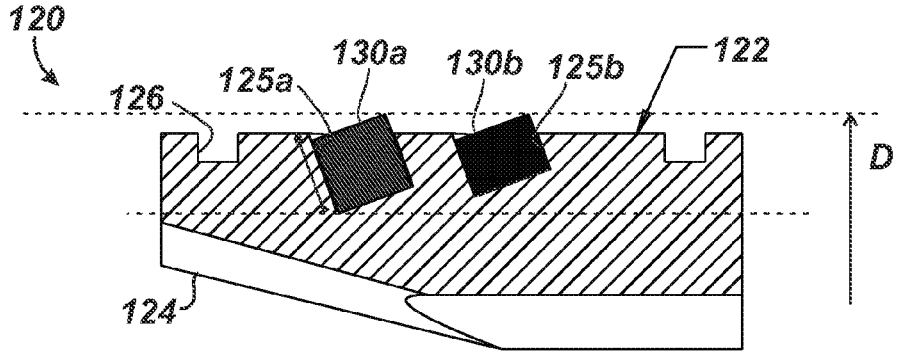
FIG. 10B illustrates a cross-section of the slip segment having inserts of different heights installed in the holes.
Figure 10C:
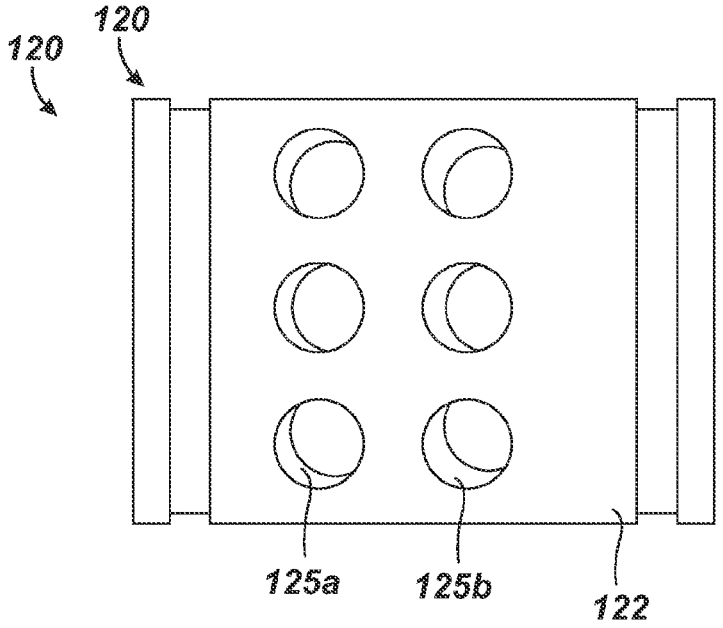
FIG. 10C is a plan view of the slip segment showing an arrangement of different depth holes.

As hinted to above, the height of the inserts 130 can be different as can be the depth of the holes in the slips 120. For example, FIGS. 10A-10B illustrate side views of a slip body or segment 122 of a slip 120 having holes 125*a*-*b* of different depths, and FIG. 10C illustrates a plan view of the segment 122 having the holes 125*a*-*b*. As depicted in FIGS. 10A and 100, the holes 125*a* toward the ramped end of the segment 122 are defined to a greater extent in the top surface of the segment 122 so that these front holes 125*a* are deeper than the back holes 125*b*. A reverse arrangement could be used.

As shown in FIG. 100, the less deep holes 125*a* are disposed in a row for three inserts, while the deeper holes 125*b* are disposed in another row for three inserts in similar columns. As will be appreciated, any configuration of rows and columns can be used here and in other embodiments disclosed herein.

As shown in FIG. 10B, even though the front holes 125*a* for the front insert 130*a* towards the ramp 124 may be formed slightly deeper in the outer surface of the slip 120 compared to the other holes 125*b* for the back insert 130*b*, the height of the two inserts 130*a*-*b* may be different so that the two inserts 130*a*-*b* extend the same distance D above the slip's surface when installed within an appropriate tolerance for the implementation. This will produce the same outside diameters for the front and trailing inserts 130*a*-*b* when the slip 120 installs on a tool.

As one example, the hole 125*a* for the front insert 130*a* towards the ramp 124 may be 0.31-in. deep, while the hole 125*b* for the trailing insert 130*b* may be 0.25-in. deep in the insert's surface. Yet, the heights of the two inserts 130*a*-*b* may be different (e.g., by about 0.06-in.) so that their extent D above the slip's surface can be about the same. This reduces the required height for the trailing insert 130*b* and can reduce the necessary metallic content of the slip 120.

Figure 11A:
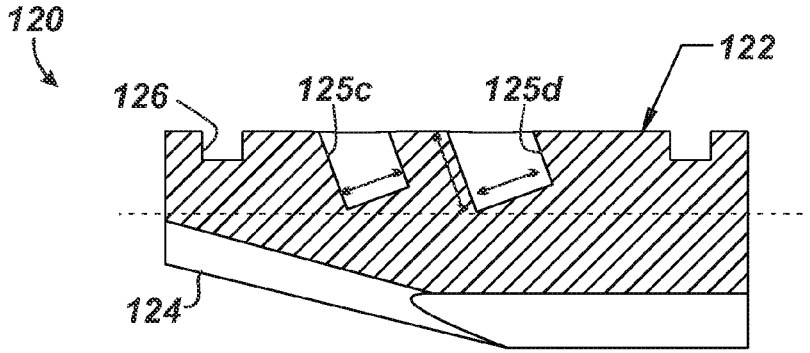
FIG. 11A illustrates a cross-section of a slip segment having holes of different widths for holding inserts therein.
Figure 11B:
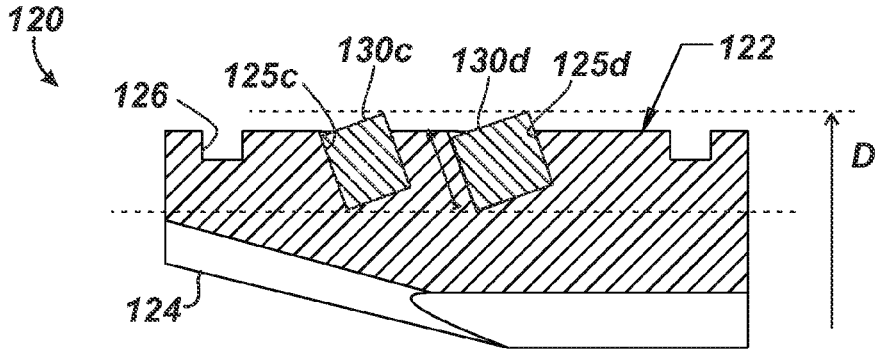
FIG. 11B illustrates a cross-section of the slip segment having inserts of different widths installed in the holes.
Figure 11C:
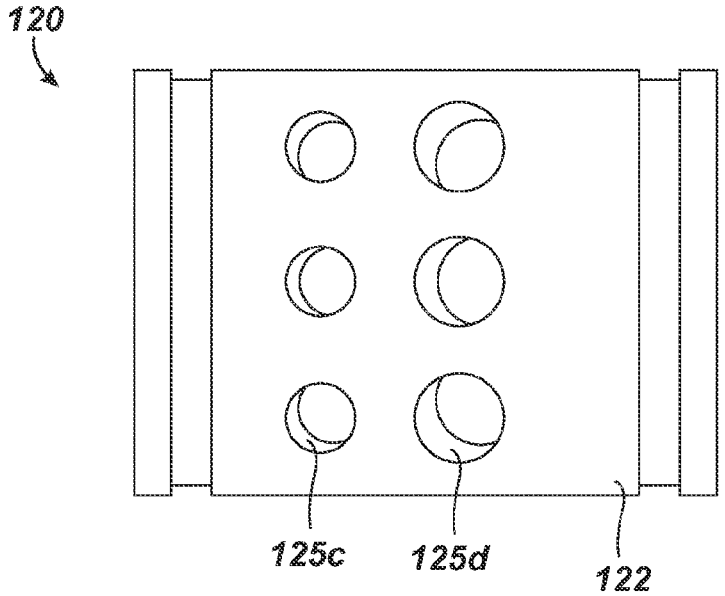
FIG. 11C illustrates a plan view of the slip segment showing an arrangement of different width holes.

Still further, the diameter of holes for inserts 130 in a slip 120 can vary from segment to segment or slip assembly to slip assembly. For example, FIGS. 11A-11B illustrate side views of a slip body or segment 122 of a slip 120 having holes 125*c-d* of different widths or diameters, and FIG. 11C illustrates a plan view of the segment 122 having the holes 125*c-d*. As depicted in FIGS. 11A and 11C, the holes 125*c* toward the ramped end of the segment 122 are narrower than the holes 125*d* toward the opposite end. A reverse arrangement could be used.

As shown in FIG. 11B, even though the front holes 125*c-d* have different diameters, the height of the two inserts 130*c-d* may be the same or different depending of the circumstances so that the two inserts 130*a-b* extend the same distance D above the slip's surface when installed within an appropriate tolerance for the implementation. This will produce the same outside diameters for the front and trailing inserts 130*a-b* when the slip 120 installs on a tool.

Figure 12A:
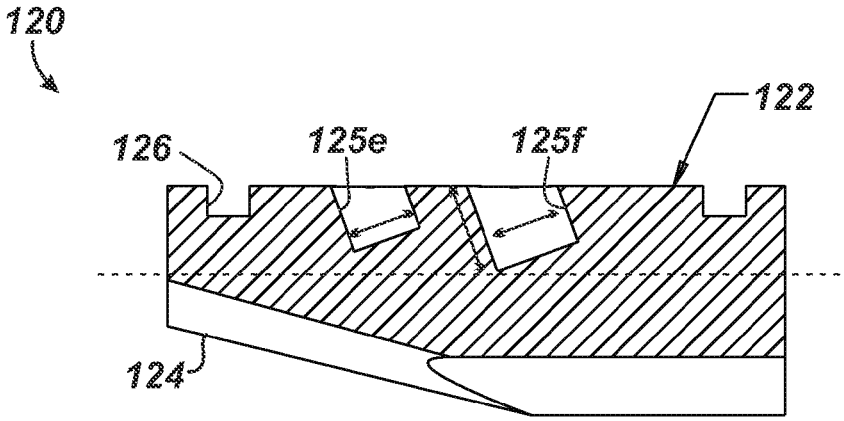
FIG. 12A illustrates a cross-section of a slip segment having holes of different depths and widths for holding inserts therein.

Given the various arrangements of holes, inserts, and the like disclosed above, additional configurations can be used on the slip bodies of a tool—some of which are discussed below. FIG. 12A illustrates a slip body or segment 122 of a slip 120 in cross-section. The segment 122 has holes 125*e-f* of both different depths and widths. The front hole 125*e* is less deep and narrower than the back hole 125*f*, although a reverse arrangement can be used.

Figure 12B:
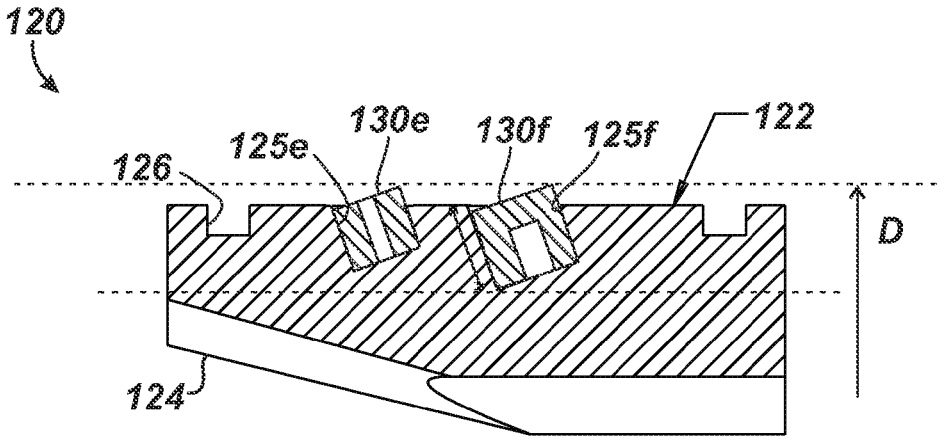
FIG. 12B illustrates a cross-section of the slip segment having different inserts installed in the holes of different depths and widths.

FIG. 12B illustrates the slip segment 122 in cross-section with different inserts 130*e-f* installed in the holes 125*e-f* of different depths and widths. The insert 130*e* in the front hole 125*e* is shorter than the insert 130*f* in the back hole 125*f* so that the inserts 130*e-f* have the same distance D above the top of the segment 122. A reverse configuration can be used. As also shown, the front insert 130*e* has a full hole therethrough, while the back insert 130*f* has a partial hole therein. However, any other configuration of inserts 130 disclosed herein can be used in the same manner.

Figure 12C:
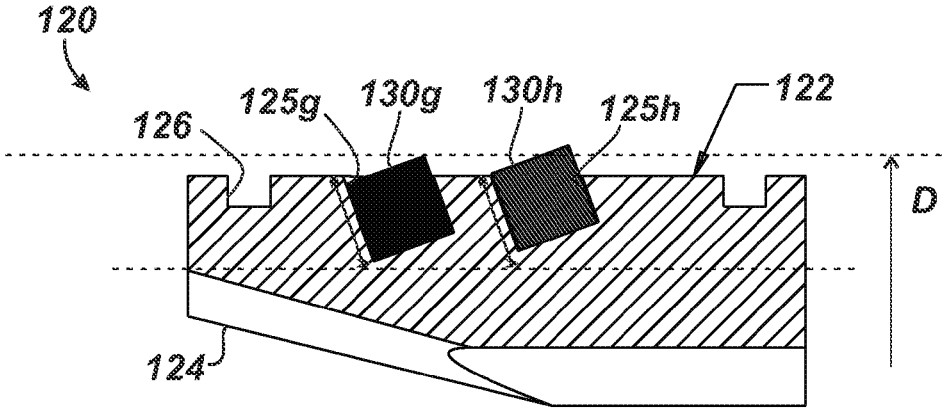
FIG. 12C illustrates a cross-section of a slip segment having holes of different depths for holding inserts of the same height installed therein.

Finally, previous embodiments have inserts 130 of different heights installed in holes 125 of different depth so that the overall extent that the inserts 130 extend from the segment 122 are the same. As an alternative, the inserts 130 can extend different distances from the segment 122. For instance, FIG. 12C illustrates a slip body or segment 122 in cross-section with holes 125*g-h* of different depths, but the inserts 130*g-h* installed in the holes 125*g-h* have the same heights. The front hole 125*g*, for example, can be deeper than the back hole 125*h*. Yet, the two inserts 130*g-h* can be the same height so that the back insert 130*h* extends a distance further from the segment's top surface than the front insert 130*g*. The reverse arrangement can also be used. Moreover, a comparable configuration can be achieved if the holes 125 are the same depth, but the inserts 130 are different heights, or if any other different arrangement is used.

Testing performed on powdered metal inserts 130 (based specifically on the cylindrical shape and dimensions discussed above with reference to FIGS. 5A-5C) has shown favorable results. For one test, a cast iron slip base was fitted with 24 powdered metal insert. The slip was then loaded up to 86,000 lbf. This is the equivalent axial force acting on a downhole slip of a 4.5" composite fracture plug at 8,000 psi set in 11.6# max casing ID. During the testing, none of the powdered metal inserts 130 chipped, and they made good indentations in the casing.

In one embodiment hinted to above, the inserts 130 of different materials, such as the powdered metal insert 130, can be arranged on both the uphole and downhole assemblies 110U, 110D of the tool 100. One, more, or all of the segments 122 of an assembly 110U, 110D can have inserts 130 composed of the same or different materials. For example, a slip assembly having one, more, or all of the inserts 130 composed of powdered metal, metallic material, and/or a non-ceramic material can be used as the uphole slip assembly 110U, the downhole slip assembly 110D, or both assemblies 110U, 110D of a downhole tool 100, such as a bridge plug used during fracturing. Likewise, a slip assembly having one, more, or all of the inserts 130 composed of ceramic material can be used as the uphole slip assembly 110U, the downhole slip assembly 110D, or both on the downhole tool 100.

Figure 13:
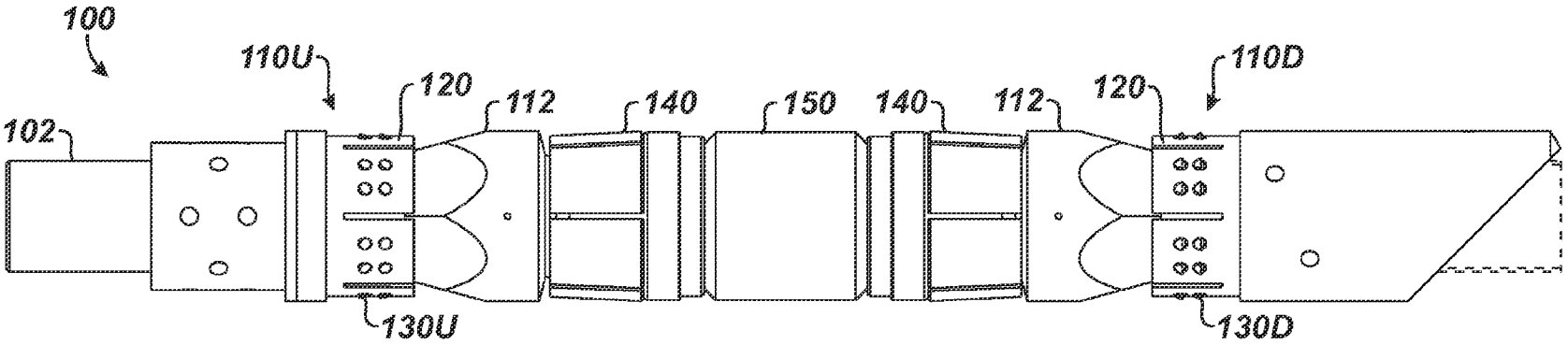
FIG. 13 illustrates another downhole tool in side view having slip assemblies according to the present disclosure.

In a particular embodiment shown in FIG. 13, a downhole tool 100, such as a bridge plug shown, uses different insert materials on the uphole and downhole assemblies 110U, 110D. The uphole slip assembly 110U has inserts 130U composed of ceramic material or other millable material to reduce the overall metallic content of the tool 100. The downhole slip assembly 110D preferably has inserts 130D composed of a metallic material, and more particularly, a powered metal material as disclosed herein.

As shown in FIG. 13, the uphole and downhole slip assemblies 110U, 110D each has a slip 120 with slip bodies, elements, or segments 122 composed of a composite material. Rather than having the independent segments 122 as discussed previously that fit around the mandrel, the segments 122 on these assemblies 110U, 110D can form slip rings having one of several integrated segments 122 of the slip 120 connected at their proximal ends.

The uphole assembly 110U uses ceramic inserts 130U disposed in the composite material of the slip 120. The ceramic material for the ceramic inserts 130U can include alumina, zirconia, cermet, or any other suitable ceramic.

The downhole slip assembly 110D uses metallic inserts 130D. The metallic material can include cast iron, carbide, powdered metal, or combination thereof. However, the metallic material used can also be a metallic-ceramic composite material, such a cermet (i.e., composites composed of ceramic and metallic materials).

During use, the tool 100 of FIG. 13 holds pressure from above the tool 100. This means that the downhole slip assembly 110D holds back all of the force generated by the pressure acting on the tool's cross-sectional area. Accordingly, the downhole slip assembly 110D preferably uses the more robust metallic inserts 130D. Additionally, in one particular embodiment, the metallic inserts 130D are powdered metal inserts as disclosed herein and can be composed of a sintered-hardened powder metal as disclosed herein.

During use, the uphole slip assembly 110U needs primarily to hold the initial setting force on the tool 100. Testing shows that slip inserts composed of ceramic materials may tend to chip during use so that the anchoring ability of the slip assembly is reduced. Yet, even with the chipping, the use of ceramic for the slip inserts 130U in the uphole slip assembly 110U can still retain enough strength to keep the tool 100 set and to perform properly. Accordingly, use of the ceramic inserts 130U in the uphole slip assembly 110U can still reduce the metallic content of the tool 100, yet achieve the hold required. The ceramic material can breakup during milling procedures, and the milled ceramic material can circulate out of the wellbore easier due to its lighter specific gravity than a metallic material.

In another configuration of the downhole tool 100 in FIG. 13, the uphole slip assembly 110U can have inserts 130U composed of powdered metal material, while the downhole slip assembly 110D can have inserts 130D composed of metallic material other than powered metal. This configuration has many of the same benefits as described above in that the millable nature of the tool 100 is increased while the downhole assembly 110D with metallic (non-powdered metal) inserts 130 can produce the required hold.

Figure 14B:
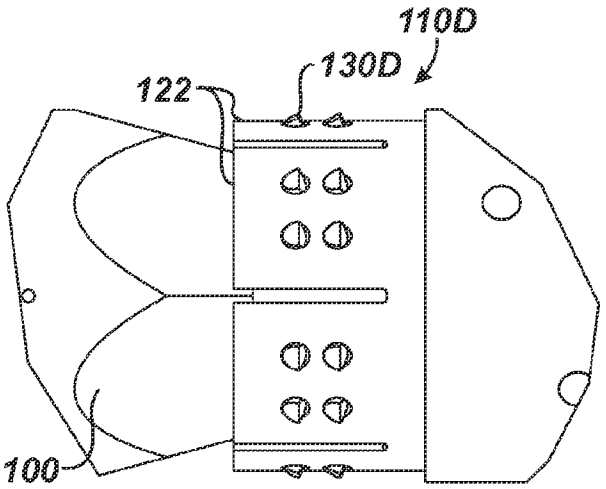
FIG. 14B illustrates a side view of the downhole slip assembly.
Figure 14A:
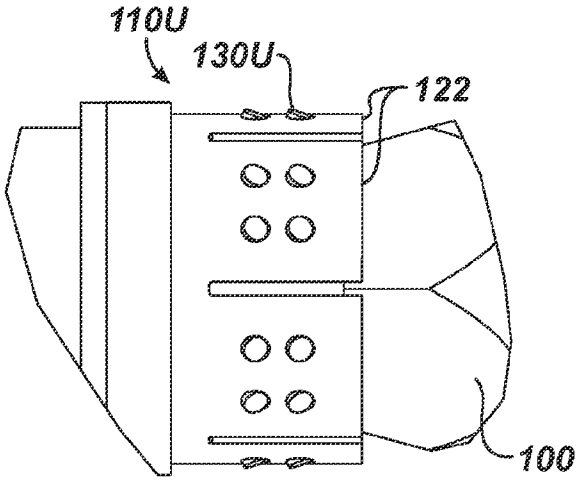
FIG. 14A illustrates a side view of the uphole slip assembly.

As shown in the detail of FIG. 14A, the inserts 130U of the uphole slip assembly 110U can all have the same geometry, although this is not strictly necessary. As shown in the detail of FIG. 14B, the same can apply to the inserts 130D of the downhole slip assembly 110D. The downhole inserts 130D can also be different than those inserts 130U used for the uphole slip assembly 110U. Again, however, this is not strictly necessary, as other configurations can be used.

Various inserts 130 disclosed herein have been described as being composed of powdered metal or ceramic materials. Other conventional materials, such as steel, iron, or high carbon steel, may be used for one, more, or all of the insets 130 in a given implementation. The slips 120 and inserts 130 can likewise have other configurations and orientations, such as those disclosed in incorporated U.S. application Ser. No. 14/039,032.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for engaging in a downhole tubular, the apparatus comprising:

a mandrel having a first end and a second end;

a sealing element disposed on the mandrel between the first and second ends and compressible to engage the downhole tubular;

a first slip disposed toward the first end of the mandrel and being movable relative to the mandrel to engage the downhole tubular, the first slip having only one or more first inserts composed of a ceramic material in exclusion of any other inserts; and a second slip disposed toward the second end of the mandrel and being movable relative to the mandrel to engage the downhole tubular, the second slip having only one or more second inserts composed of a metallic material in exclusion of any other inserts.

2. The apparatus of claim 1, wherein the first and second slips each comprise a slip body composed of a non-metallic material.

3. The apparatus of claim 2, wherein the non-metallic material comprises a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

4. The apparatus of claim 1, wherein the first and second slips each comprise a plurality of segments disposed about the mandrel.

5. The apparatus of claim 1, wherein the metallic material of the one or more second inserts comprises a cast iron, a carbide, a metallic-ceramic composite material, a cermet, a powdered metal, or a combination thereof.

6. The apparatus of claim 5, wherein the powdered metal is selected from the group consisting of a sintered-hardened powdered metal steel material, a powdered metal iron material, and a powdered metal high carbon steel material.

7. The apparatus of claim 6, wherein the sintered-hardened powdered metal steel material consists essentially of a balance of iron, an admixture of carbon, and alloy components of molybdenum, chromium, and manganese.

8. The apparatus of claim 1, wherein the ceramic material comprises alumina, zirconia, or cermet.

9. The apparatus of claim 1, wherein the first end of the mandrel is an uphole end such that the first slip is disposed toward the uphole end of the mandrel, and wherein the second end is a downhole end such that the second slip is disposed toward the downhole end of the mandrel.

10. The apparatus of claim 9, wherein the first slip supports the sealing element compressed, and wherein the second slip supports fluid pressure downhole of the tool.

11. The apparatus of claim 1, wherein the mandrel is composed of a third material comprising a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

12. The apparatus of claim 1, wherein at least one of the first and second inserts defines at least a partial hole axially therethrough.

13. A downhole apparatus for engaging in a downhole tubular, the apparatus comprising:

a slip disposed on the downhole apparatus and being movable relative to the downhole apparatus to engage the downhole tubular, the slip having an outside surface and first and second ends, the outside surface defining a first hole toward the first end and defining a second hole toward the second end, the first hole having a different depth in the outside surface than the second hole;

a first insert disposed in the first hole, the first insert having a first length and extending a first extent from the outside surface on the slip; and a second insert disposed in the second hole, the second insert having a second length and extending a second extent from the outside surface on the slip.

14. The tool of claim 13, wherein the first length is different from the second length.

15. The tool of claim 14, wherein the first and second extents are approximately the same.

16. The tool of claim 13, wherein the first depth is greater than the second depth, wherein the first length is greater than the second length, and wherein the first and second extents are approximately the same.

17. The tool of claim 13, the first hole has a different width than the second hole.

18. The apparatus of claim 13, wherein the first and seconds inserts are composed of a cast iron, a carbide, a metallic-ceramic composite material, a ceramic material, an alumina, a zirconia, a cermet, a powdered metal, a sintered-hardened powdered metal steel material, a powdered metal iron material, a powdered metal high carbon steel material, or a combination thereof.

19. The apparatus of claim 13, wherein the slip is composed of a non-metallic material comprising a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

20. The apparatus of claim 13, comprising a mandrel having the slip disposed thereon.

21. The apparatus of claim 20, wherein the slip comprises a plurality of segments disposed about the mandrel.

22. The apparatus of claim 20, wherein the mandrel comprises a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

23. The apparatus of claim 20, wherein the mandrel has a first end and a second end and has the slip disposed toward the first end.

24. The apparatus of claim 23, comprising a sealing element disposed on the mandrel between the first and second ends and being compressible to engage the downhole tubular.

25. The apparatus of claim 24, further comprising a second slip disposed toward the second end of the mandrel and being movable relative to the mandrel to engage the downhole tubular, the second slip having at least a third insert different from the first and second inserts.

26. The apparatus of claim 25, wherein the first or second end of the mandrel is an uphole end such that the slip is disposed toward the uphole end of the mandrel, and wherein the other of the first or second end is a downhole end such that the second slip is disposed toward the downhole end of the mandrel.

27. The apparatus of claim 13, wherein at least one of the first and second inserts defines at least a partial hole axially therethrough.

* * * * *